US007997324B2

(12) United States Patent
Olmsted

(10) Patent No.: US 7,997,324 B2
(45) Date of Patent: Aug. 16, 2011

(54) MOVEABLE BARRIER SYSTEMS

(75) Inventor: Robert Olmsted, Wood Dale, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 46 days.

(21) Appl. No.: 11/517,776

(22) Filed: Sep. 8, 2006

(65) Prior Publication Data

US 2007/0095487 A1 May 3, 2007

Related U.S. Application Data

(60) Provisional application No. 60/716,298, filed on Sep. 12, 2005.

(51) Int. Cl.

| | |
|---|---|
| ***E05D 15/00*** | (2006.01) |
| ***E05F 11/00*** | (2006.01) |
| ***E05F 13/00*** | (2006.01) |
| ***E05F 15/00*** | (2006.01) |

(52) U.S. Cl. ..... 160/201; 160/188

(58) Field of Classification Search ..... 160/188, 160/201, 310, 189; 49/199, 200; 403/348
See application file for complete search history.

(56) References Cited

U.S. PATENT DOCUMENTS

| | | | | | |
|---|---|---|---|---|---|
| 1,724,995 | A | * | 8/1929 | Dautrick | 160/191 |
| 1,916,651 | A | * | 7/1933 | Beeman et al. | 160/189 |
| 2,083,467 | A | * | 6/1937 | Morris | 160/191 |
| 2,099,191 | A | * | 11/1937 | Blodgett | 160/189 |
| 2,588,879 | A | * | 3/1952 | Richards | 160/189 |
| 2,676,294 | A | * | 4/1954 | Wilcox | 318/266 |
| 2,742,280 | A | * | 4/1956 | Wilcox | 160/189 |
| 2,882,044 | A | * | 4/1959 | Ginte | 318/266 |
| 2,922,638 | A | * | 1/1960 | Smith | 74/89.17 |
| 3,147,001 | A | * | 9/1964 | Purdy | 49/139 |
| 3,336,968 | A | * | 8/1967 | Curtis | 160/188 |
| 3,616,575 | A | * | 11/1971 | Harris | 49/200 |
| 3,685,567 | A | * | 8/1972 | Pemberton et al. | 160/8 |
| 3,955,661 | A | * | 5/1976 | Popper et al. | 192/150 |
| 4,032,045 | A | * | 6/1977 | Epple | 222/146.5 |
| 4,191,237 | A | * | 3/1980 | Voege | 160/188 |
| 4,417,418 | A | * | 11/1983 | Warning | 49/199 |
| 4,472,910 | A | * | 9/1984 | Iha | 49/139 |
| 4,964,221 | A | * | 10/1990 | Breyer et al. | 33/503 |
| 4,984,387 | A | * | 1/1991 | Wheatland | 49/362 |
| 5,036,899 | A | | 8/1991 | Mullet | |
| 5,117,656 | A | * | 6/1992 | Keck et al. | 62/506 |
| 5,263,527 | A | * | 11/1993 | Marlatt et al. | 160/7 |
| 5,394,923 | A | * | 3/1995 | Danziger | 160/188 |
| 5,572,829 | A | * | 11/1996 | Stoltenberg | 49/200 |
| 5,581,939 | A | | 12/1996 | Regan et al. | |
| 5,698,073 | A | * | 12/1997 | Vincenzi | 160/188 |
| 5,803,149 | A | * | 9/1998 | Halley et al. | 160/201 |
| 5,931,212 | A | | 8/1999 | Mullet et al. | |
| 6,014,307 | A | * | 1/2000 | Crimmins | 361/170 |
| 6,134,835 | A | * | 10/2000 | Krupke et al. | 49/200 |

(Continued)

*Primary Examiner* — Blair M Johnson
*Assistant Examiner* — Jaime F Cárdenas-Garcia
(74) *Attorney, Agent, or Firm* — Fitch Even Tabin & Flannery

(57) ABSTRACT

A support assembly for a barrier movable between open and closed positions over an opening comprises a track. The track is attached to the wall for guiding movement of the barrier between substantially vertical closed position and a substantially horizontal open position. A jack shaft assembly is attached to the track and to the barrier for movement thereof. A mounting assembly is attached to the track for receiving a drive unit comprising a motor for supplying power to the jack shaft assembly to move the barrier and for limiting rotational movement of the drive unit.

17 Claims, 2 Drawing Sheets

U.S. PATENT DOCUMENTS 6,155,324 A * 12/2000 Elliott et al. ..... 160/1
6,257,303 B1 7/2001 Coubray et al.
6,276,744 B1 * 8/2001 Huber et al. ..... 296/155
6,414,454 B1 * 7/2002 Lhotak et al. ..... 318/266
6,719,033 B2 * 4/2004 Stoltenberg ..... 160/188
6,745,814 B2 * 6/2004 Hoofard et al. ..... 160/201
6,789,599 B2 * 9/2004 Schutz ..... 160/188
2002/0129907 A1 * 9/2002 Schutz et al. ..... 160/188
2004/0177934 A1 * 9/2004 Olmsted ..... 160/188
2007/0200519 A1 * 8/2007 Murphy et al. ..... 318/280

* cited by examiner

Fig. 1
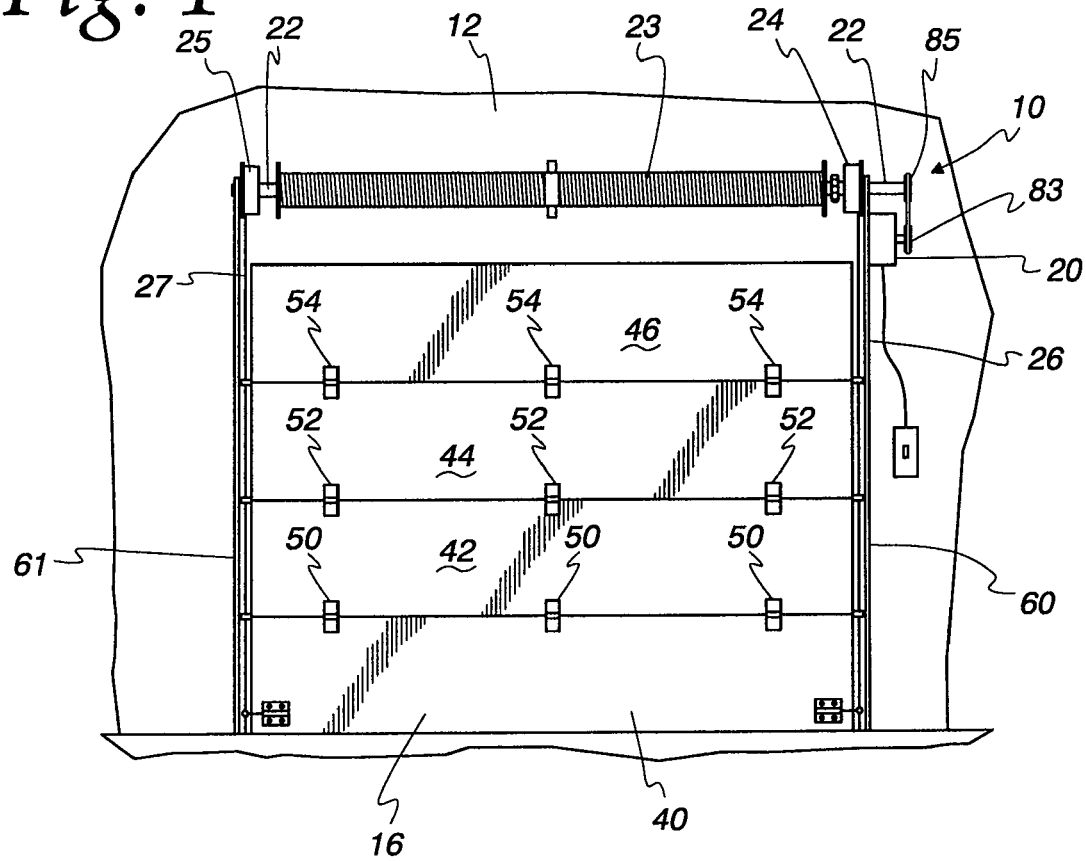
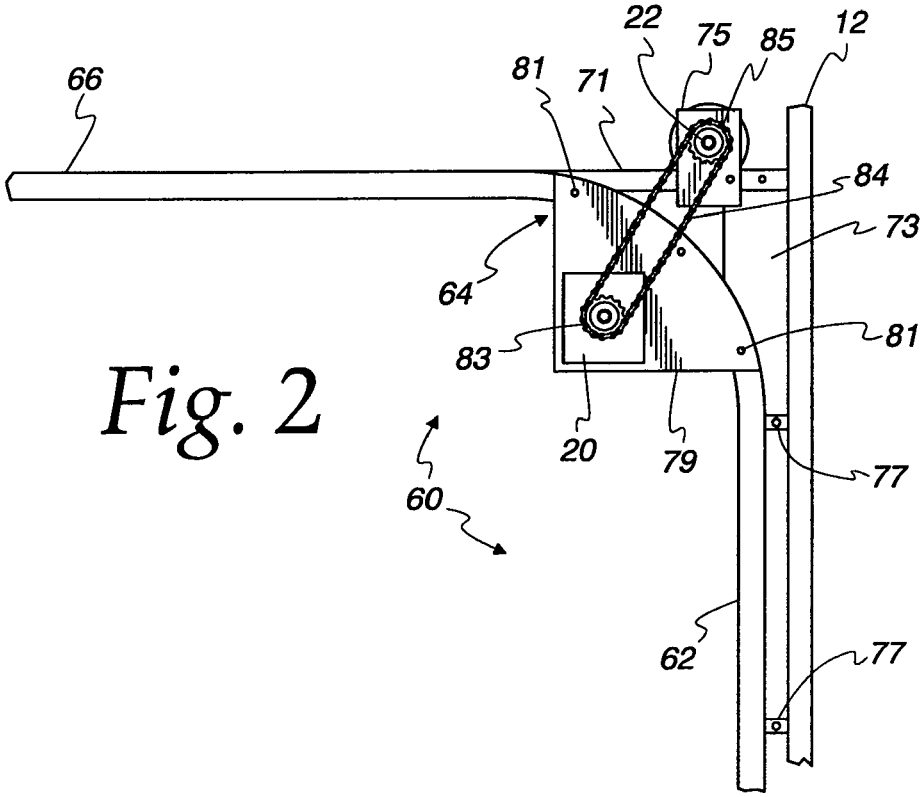
Fig. 2

MOVEABLE BARRIER SYSTEMS

CROSS REFERENCES TO RELATED APPLICATIONS

The present application claims the benefit of prior provisional application Ser. No. 60/716,298, entitled "Moveable Barrier Systems," filed Sep. 12, 2005 and incorporated herein by reference in its entirety.

BACKGROUND

The present invention relates to controlling the movement of a barrier with respect to an opening in a wall.

Powered barrier operators are known and have been used to automatically move barriers such as garage doors. One type of barrier operator, referred to herein as a jack shaft operator, includes a jack shaft mounted above the door opening and including one or more flexible cables which are attached to the vertically moving door near the bottom thereof.

In known jack shaft operator systems, tracks to guide door movement are mounted to the carpentry frame surrounding a door opening in a wall and the jack shaft is mounted to the support for the tracks and/or to a header above the opening. Cables are also used to connect drums or sprockets on the jack shaft to the door near its bottom. The door is moved by a motor which is attached to the wall near the jack shaft to power rotation thereof. Such coupling may include chains, belts or gears. After assembly, energizing the motor to rotate causes the door to be raised or lowered, depending on the direction of rotation.

The above structure and method may create difficulties in the assembly and use of an automated barrier movement system. The motor housing must be attached to a structural part of the wall, such as wall studs, in order to reliably resist the rotational forces created when the motor is energized. Frequently, there is no structural part where one is needed so the barrier installer must build one. Further, if the wall structure has been covered by for example, plaster or drywall, the finding of a structural part even if present may be difficult and time consuming. In other previous systems, the motor of the operator must be placed above the barrier in order to allow the system to function properly.

DRAWINGS

FIG. 1 is an elevational view of a portion of a garage showing the movement of a garage door therein;

FIG. 2 shows the attachments of a door guide track in a garage and the attachment of a drive unit and jack shaft thereto;

Figure 3A:
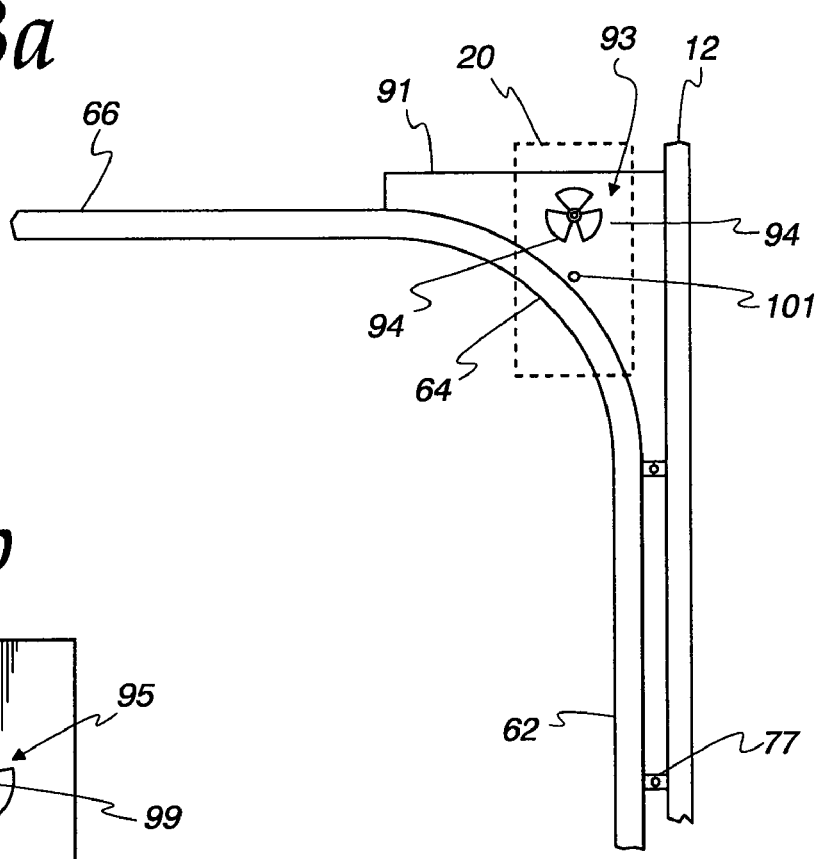
Figure 3B:
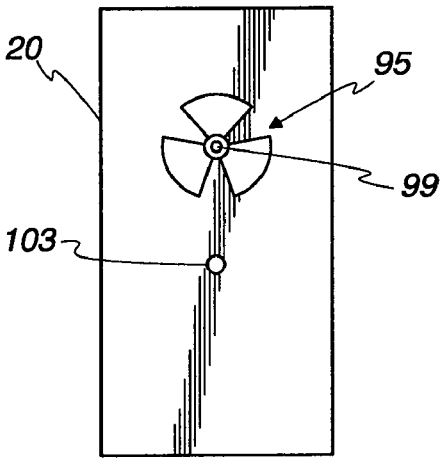

FIG. 3*a* shows the attachment of a door guide track in a garage and an alternative attachment of a drive unit;

FIG. 3*b* shows a side view of a drive unit having a bayonet mount; and

Figure 3C:
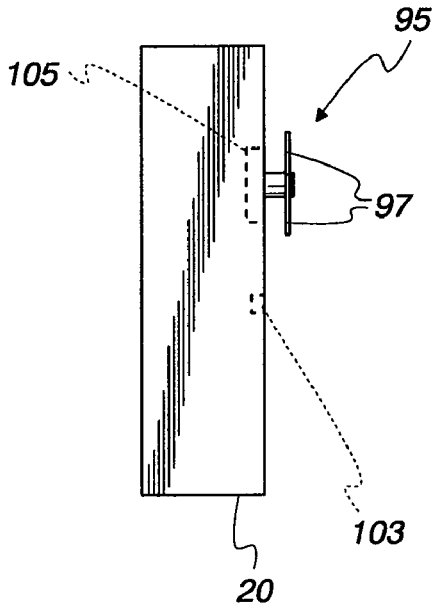

FIG. 3*c* shows a front view of the drive unit of FIG. 3*b*.

DESCRIPTION

FIG. 1 shows a garage door 16 mounted to cover and uncover an opening (not shown) in a garage wall 12. Door 16 is mounted by rollers in a pair of L shaped tracks 60 and 61. The tracks 60 and 61 are in turn mounted to the carpentry frame (not shown) defining the opening. The barrier is moved by a jack shaft garage door operator generally shown at numeral 10. The jack shaft garage door operator 10 includes a drive unit 20 having a jack shaft 22 coupled thereto to be turned thereby. The jack shaft 22 includes a spring 23. A pull-up cable drum 24 is mounted on the jack shaft 22 to be turned and a pull-up cable 26 is wound around the cable drum 24 to be pulled upwardly.

More particularly, the garage door 16 is a multiple paneled door consisting of a plurality of rectangular panels 40, 42, 44 and 46. The panels 40 and 42 are connected by a plurality of hinges 50. Panels 42 and 44 are connected by a plurality of hinges 52. Panels 44 and 46 are connected by a plurality of hinges 54. The door is carried by multiple rollers in a pair of L-shaped tracks. The exemplary L-shaped track 60 shown in FIG. 2 includes a vertical portion 62, a curved portion 64 and a horizontal portion 66. Rollers positioned on respective shafts mounted to the door panels ride in the track 60 and carry the door panels upwardly and downwardly. In operation, the drive unit 20 cooperates with the jack shaft 22 (including the spring 23) to move the garage door 16. For instance, when the door 16 is lowered, the jack shaft 22 (and the spring 23) are rotated to pay out the cables 26 and a corresponding cable 27 at the other side of the door from the pull-up cable drums 24 and 25.

The L shaped track 60, its mounting to wall 12 and the mounting of the drive unit 20 and jack shaft operator 10 is shown in more detail in FIG. 2. Track 60 includes a pair of support members 71 and 73 which add additional support to the curved track section 64 and provide an attachment for jack shaft mounting member 75. Support member 73 also provides an attachment points to wall 12 with a separation therebetween as do stand off attachments 77. Drive unit 20 is attached to track 60 at the curved portion 64 thereof. As shown in FIG. 2 a sheet steel attachment 79 is attached by means of fasteners 81 to the curved portion of track 64 and the drive unit 20 is affixed thereto. Power is conveyed by a motor of drive unit 20 to a pulley 83 which is further coupled to a pulley 85 attached to rotate the jack shaft 22 including the spring 23. In the present embodiment power is conveyed from pulley 83 to pulley 85 of the jack shaft 22 by means of a flexible belt 84 although other flexible or geared coupling means could be used.

Attaching drive unit 20 and jack shaft assembly 10 to the tracks 60 and 61 rather than to the wall provides improved ease of assembly. Prior systems attached the drive unit to the wall which attachment frequently required the location of carpentry members in the wall and/or the construction of such by the garage door assembler. Further, because the placement of the various components in any given location could not be predicted before assembly, a wide array of parts needed to be carried by the assembler. Attachment of the drive unit 20 to the tracks 60 and 61 eliminates the need for support carpentry on the part of the assembler and reduces the parts which may have to be brought to the assembly site by the assembler. In addition, the drive unit 20 can be positioned anywhere relative to the garage door 16 (e.g., even below the door 16).

In the preceding embodiment the drive unit 20 is attached to the door guiding track and power is conveyed to the jack shaft 22 by means of a flexible coupling. FIG. 3*a*-3*c* show an assembly system in which the drive unit 20 is mounted directly over the end of jack shaft 22 and power is coupled to the jack shaft 22 internally to the drive unit 20 housing. In FIG. 3*a*, a track consisting of sections 62, 64 and 66 is connected to a garage wall 12 by means of a standoff 77 and a sheet steel support member 91. A female bayonet opening 93 is formed in support 91 to provide a means of attaching the drive unit 20 to the guide track. FIGS. 3*b* and 3*c* present front and side views of a drive unit 20 having the mating male portions 95 of a bayonet mount. As best seen in FIG. 3*c* the bayonet 95 includes flanges 97 which fit into the wing openings 94 of female bayonet opening 93. Thus, in the manner well known for bayonet mounts, the two bayonet portions can be mated and rotated to lock them together. Advantageously, a fastener such as a bolt may be used to connect through a hole 101 in support 91 and attached to a threaded hole 103 in the drive unit. The support 91 may include a conventional bearing for support of the end of jack shaft 22 which protrudes through the opening 93 and into the unit 20 via an opening 99. Power attachment to the jack shaft can then be completed within the drive unit. Alternatively, drive unit 20 may include an operational bearing 105 which provides end support for the jack shaft 22.

While there has been illustrated and described particular embodiments of the present invention, it will be appreciated that numerous changes and modifications will occur to those skilled in the art, and it is intended in the appended claims to cover all those changes and modifications which fall within the true scope of the present invention.

What is claimed is:

1. A support assembly configured to support a moveable barrier which moves between open and closed positions in an opening in a wall comprising:

a track configured for attachment to the wall which track guides movement of the barrier between a substantially vertical closed position and a substantially horizontal open position, the track having a vertical portion and a horizontal portion and a curved portion therebetween;

a jack shaft configured for attachment to the barrier for movement thereof and having a longitudinal axis perpendicular to the track, the jack shaft having an end portion;

a bayonet mount having a longitudinal axis perpendicular to the track;

a drive unit; and a support member coupled to the track at about the curved portion thereof and which support member supports and holds the drive unit away from the wall, the drive unit coupled to the support member in a lockable engagement via the bayonet mount, the connection between the bayonet mount and the support member effective to support and hold the drive unit against the support member and above the ground, the longitudinal axis of the jack shaft being aligned with the longitudinal axis of the bayonet mount such that the end portion of the jack shaft extends through at least portions of the bayonet mount into the interior of the drive unit to power the jack shaft for rotational movement around the longitudinal axis of the jack shaft and to move the barrier and the support member holding the drive unit and supporting the drive unit with the track away from the wall and limiting rotational movement of the drive unit being translated to the wall.

2. The support assembly of claim 1 wherein the support member is coupled to the track such that the drive unit received by the support member is positioned to be substantially entirely above the curved portion of the track.

3. A method of assembling a movable barrier support structure which guides movement of a movable barrier from a horizontal open position to a vertical closed position in an opening in a wall, the method comprising:

attaching at least one barrier guiding track to the wall in proximity to the opening, the track having a horizontal portion, a vertical portion and a curved portion therebetween;

attaching a support member at about the curved portion of the track;

attaching a drive unit to the support member in a lockable engagement with a bayonet mount to support the drive unit with the track without direct attachment between the drive unit and the wall, the drive unit having a longitudinal axis perpendicular to the track;

aligning a longitudinal axis of a jack shaft with the longitudinal axis of the bayonet mount and extending an end portion of the jack shaft through at least portions of the bayonet mount into the interior of the drive unit to couple the drive unit to the support member and to the jack shaft, the jack shaft having a longitudinal axis which is perpendicular to the track, the drive unit providing for rotational movement of the jack shaft around its longitudinal axis, a power output of the drive unit configured to move the jack shaft for movement of the barrier;

the connection between the bayonet mount and the support member being effective to support and hold the drive unit against the support member and above the ground.

4. The method of claim 3 wherein attaching the drive unit to the at least one barrier guiding track comprises attaching the drive unit to the at least one barrier guiding track such that the drive unit is positioned to be substantially entirely above the curved portion of the at least one barrier guiding track.

5. A support assembly configured to support a moveable barrier which moves between open and closed positions in an opening in a wall, the support assembly comprising:

a track configured for attachment to the wall which track guides movement of the barrier between a substantially vertical closed position and a substantially horizontal open position, the track having a vertical portion and a horizontal portion and a curved portion therebetween;

a drive unit coupled to the curved portion of the track;

a support member coupled to the track;

a jack shaft having a longitudinal axis perpendicular to the track;

a bayonet mount having a longitudinal axis perpendicular to the track;

the support member attached to the drive unit in a lockable engagement via the bayonet mount, the connection between the bayonet mount and the support member effective to support and hold the drive unit against the support member and above the ground, the longitudinal axis of the jack shaft being aligned with the longitudinal axis of the bayonet mount such that the end portion of the jack shaft extends through at least portions of the bayonet mount into the interior of the drive unit, the jack shaft coupled to the barrier for movement thereof between the open and closed positions;

the support member supporting the drive unit and the support member holding the drive unit in a spaced relation from the wall without the drive unit being attached to or supported by the wall except through the track and support member.

6. The support assembly of claim 1, wherein the support assembly further includes stand off attachments which are configured to couple the track with the wall and space the track from the wall.

7. The support assembly of claim 5, wherein the support assembly further includes stand off attachments which are configured to couple the track with the wall and space the track from the wall.

8. The support assembly of claim 7, wherein the support assembly further includes a support member attached to the curved portion of the track and the drive unit is attached to the support member.

9. A support assembly configured to support a moveable barrier which moves between open and closed positions in an opening in a wall comprising:

a track configured for attachment to the wall which track guides movement of the barrier between a substantially vertical closed position and a substantially horizontal open position, the track having a vertical portion and a horizontal portion and a curved portion therebetween;

a drive unit coupled to the curved portion of the track;

a support member coupled to the track;

a jack shaft having a longitudinal axis perpendicular to the track;

a bayonet mount having a longitudinal axis perpendicular to the track; and the support member operatively coupled to the drive unit in a lockable engagement with a bayonet mount, the connection between the bayonet mount and the support member effective to support and hold the drive unit against the support member above the ground, the longitudinal axis of the jack shaft being aligned with the longitudinal axis of the bayonet mount such that the end portion of the jack shaft extends through at least portions of the bayonet mount into the interior of the drive unit, the jack shaft being coupled to the barrier for movement thereof between the open and closed positions, the bayonet mount being operable to connect the drive unit to the end of the jack shaft during an installation time period, the support member supporting the drive unit and the support member holding the drive unit in a spaced relation from the wall without the drive unit being attached to or supported by the wall except through the track and support member.

10. The support assembly of claim 9, wherein the support assembly further includes a support member attached to the curved portion of the track and the drive unit is attached to the support member.

11. The support assembly of claim 9, wherein the support assembly further includes stand off attachments which are configured to couple the track with the wall and space the track from the wall.

12. The support assembly of claim 10, wherein the support assembly further includes stand off attachments which are configured to couple the track with the wall and space the track from the wall.

13. The support assembly of claim 1 wherein the bayonet mount comprises a male portion and a female portion, and the male portion has two or more flanges.

14. The method of claim 9 wherein the bayonet mount comprises a male portion and a female portion, and the male portion has two or more flanges.

15. The support assembly of claim 5 wherein the bayonet mount comprises a male portion and a female portion, and the male portion has two or more flanges.

16. The support assembly of claim 9 wherein the bayonet mount comprises a male portion and a female portion, and the male portion has two or more flanges.

17. A support assembly configured to support a moveable barrier which moves between open and closed positions in an opening in a wall, the support assembly comprising:

a track configured for attachment to the wall which track guides movement of the barrier between a substantially vertical closed position and a substantially horizontal open position, the track having a vertical portion and a horizontal portion and a curved portion therebetween;

a jack shaft configured for attachment to the barrier for movement thereof and having a longitudinal axis perpendicular to the track, the jack shaft having an end portion;

a bayonet mount having a longitudinal axis perpendicular to the track;

a drive unit; and a support member coupled to the track at about the curved portion thereof and which support member supports and holds the drive unit away from the wall, the drive unit coupled to the support member in a lockable engagement via the bayonet mount, the connection between the bayonet mount and the support member effective to support and hold the drive unit against the support member and above the ground, the longitudinal axis of the jack shaft being aligned with the longitudinal axis of the bayonet mount such that the end portion of the jack shaft is coupled to the drive unit to power the jack shaft for rotational movement around the longitudinal axis of the jack shaft and to move the barrier and the support member holding the drive unit and supporting the drive unit with the track away from the wall and limiting rotational movement of the drive unit being translated to the wall.

* * * * *

UNITED STATES PATENT AND TRADEMARK OFFICE

CERTIFICATE OF CORRECTION

PATENT NO. : 7,997,324 B2
APPLICATION NO. : 11/517776
DATED : August 16, 2011
INVENTOR(S) : Robert Olmsted It is certified that error appears in the above-identified patent and that said Letters Patent is hereby corrected as shown below:

IN THE CLAIMS:

Claim 14, Column 6, Line 4; change “claim 9” to -- claim 3 --.

Signed and Sealed this
Twenty-ninth Day of May, 2012

David J. Kappos

David J. Kappos
*Director of the United States Patent and Trademark Office*